United States Patent [19]

Adams et al.

[11] Patent Number: 4,573,597

[45] Date of Patent: Mar. 4, 1986

[54] CONTAINERS

[75] Inventors: John F. E. Adams, Caversham; Philip J. G. Proffit, Wantage; Nicholas R. Oakley, Swindon; Rickworth Folland, Faringdon, all of England

[73] Assignee: Metal Box p.l.c., Reading, England

[21] Appl. No.: 645,316

[22] PCT Filed: Dec. 20, 1983

[86] PCT No.: PCT/GB83/00338

§ 371 Date: Aug. 23, 1984

§ 102(e) Date: Aug. 23, 1984

[87] PCT Pub. No.: WO84/02508

PCT Pub. Date: Jul. 5, 1984

[30] Foreign Application Priority Data

Dec. 23, 1982 [GB] United Kingdom ..... 8236599

[51] Int. Cl.[4] ..... B65D 25/24

[52] U.S. Cl. ..... 215/12 R; 215/1 C; 215/100 R; 220/69

[58] Field of Search ..... 215/1 C, 12 R, 100 R; 220/69, 70

[56] References Cited

U.S. PATENT DOCUMENTS

| | | | |
|---|---|---|---|
| 299,673 | 6/1884 | O'Hara | 220/69 |
| 3,760,968 | 9/1973 | Amberg et al. | 215/12 R |
| 3,881,621 | 5/1975 | Adomattis | 215/12 R X |
| 3,927,782 | 12/1975 | Edwards | 215/12 R X |
| 3,948,404 | 4/1976 | Collins et al. | 215/12 R X |
| 3,952,898 | 4/1976 | Bayer | 215/12 R |
| 4,108,324 | 8/1978 | Krishnakumar et al. | 215/1 C |
| 4,241,839 | 12/1980 | Alberghini | 215/1 C X |
| 4,293,359 | 10/1981 | Jakobsen | 215/1 C X |
| 4,326,638 | 4/1982 | Nickel et al. | 215/12 R |
| 4,367,820 | 1/1983 | Yoshino et al. | 215/12 R |
| 4,375,442 | 3/1983 | Ota et al. | 215/1 C X |
| 4,436,216 | 3/1984 | Chang | 215/1 C X |

FOREIGN PATENT DOCUMENTS

| | | |
|---|---|---|
| 2115383 | 7/1972 | France . |
| 934246 | 8/1963 | United Kingdom . |
| 1175048 | 12/1969 | United Kingdom . |
| 1501662 | 2/1978 | United Kingdom . |
| 2085395 | 4/1982 | United Kingdom . |

*Primary Examiner*—William Price
*Assistant Examiner*—Sue A. Weaver
*Attorney, Agent, or Firm*—Burns, Doane, Swecker & Mathis

[57] ABSTRACT

A bottle for carbonated beverage is moulded from polyethylene terephthalate (PET) thermoplastics resin and has a recessed base (14) formed by a standing ring (15) and an outwardly domed central panel (21). A ring member attached to the base by spin-welding receives the crest (19) of the standing ring and extends along the inner wall of the standing ring to the central panel so as to control distortion of the base when the bottle is pressurized. The ring member is made of PET so that the bottle is readily recyclable.

12 Claims, 7 Drawing Figures

CONTAINERS

This invention relates to containers made of thermoplastics resin materials, and is directed to standing bases for such containers. The invention has particular, but not exclusive, application to screw-top bottles for carbonated beverages.

It is well known to make carbonated beverage bottles from thermoplastics polymers, in particular polyethylene terephthalate (PET), by a blow moulding operation performed on an extended tubular parison or an injection moulded preform. Carbonated beverages, e.g. beer, can generated in the bottles internal pressures of several atmospheres in magnitude, and in order to withstand such pressures without eversion or other uncontrolled deformation it has been proposed that the bases of the bottles should be outwardly (i.e. convexly) domed to rounded or generally hemispherical form.

In order to enable the bottles to be stood upright it has further been proposed that either the bottle bases should be modified by the superposition of integral standing feet on the outside of the generally rounded base contour, or the bottles should be fitted with separate standing cups providing annular standing surfaces extending around, and proud of, the bottle bases.

However, each of these expedients has disadvantages. For both expedients the rounded standing bases represent a substantial height (axially of the bottle), so correspondingly reducing the area available for printing or labelling. The provision of integral standing feet requires exacting design and close control of the moulding operation if satisfactory bottles are to be produced at high speed and over long production runs. Furthermore, the standing feet themselves represent a substantial additional requirement for the thermoplastics material, which is likely to be relatively expensive to provide the low gas permeability required for the bottle; moreover, the feet are visible from the side of the bottle and are visually unattractive, and when the bottles are passing at high speed along a filling line they tend to catch in irregularities, joints, etc., of the conveyor so that, in these circumstances at least, the stability which they impart to the bottles is unsatisfactory.

A standing cup may be made from a thermoplastics material which is cheap in relation to that of the bottle proper, but the difference in materials then creates a separation problem if the materials are to be recycled after the bottle has been used. Moreover, the rounded base of the bottle is unsightly, and for visual appeal, maximum stability and/or ease of attachment and location, the cup conventionally has an upturned cylindrical skirt which extends, in generally flush relation to the bottle body, for the whole height of the base. The skirt is therefore extensive in area, and correspondingly has a substantial material requirement; the relative cheapness of the cup material in relation to that of the body therefore does not result in any substantial economies. A further disadvantage of the standing cups now employed is that they tend to give the purchaser of the bottles a greater impression of the quantity of product than in fact exists, so leading to a degree of consumer resistance.

A further base arrangement for a carbonated beverage bottle is disclosed in U.S. Pat. No. 4,108,324. In that Specification there is described a one-piece thermoplastics bottle of which the base is recessed within an annular standing ring. In order to rigidify and stabilise the base against eversion and "rolling-out", hollow, shallow projections are formed at regular intervals around the wall of the recess and extend radially inwardly towards the centre of the base. This base configuration suffers from the same or similar disadvantages as the rounded base configuration of the one-piece bottle described above except that the appearance of the bottle is improved; moreover, the recessed base configuration is inherently less able to withstand carbonation pressures than the rounded base configuration, and despite the rigidifying projections the material thickness of the base may need to be made correspondingly greater than before for the same carbonated pressure, with concomitantly increased material costs.

The present invention seeks to provide a thermoplastics container with a standing base having the advantages provided by central recessing as in U.S. Pat. No. 4,108,324 without the requirement to mould the base with rigidifying features or to increase the material thickness of the base to counteract the inherent tendancy of the base to evert or roll out by virtue of its recessed configuration. Accordingly, the invention provides a thermoplastics container having a body with a standing base, the base being formed with a central recess and having a standing ring with a crest which defines the periphery of the recess, for controlling distortion of the base against internal pressure of the container, the container further comprising a ring member which receives the crest generally in nested relation so as when the container is pressurised to be in cooperation with the base both within the recess and outside the crest, the ring member being bonded to the base outside the crest but within the crest being free of the base so that the base is movable relative thereto, and into engagement therewith, when the container is pressurised.

In a described embodiment of the invention the standing ring has an upwardly and outwardly tapering substantially frustoconical outer wall to which the ring member is bonded, the location of the bond being such that forces which it is required to withstand and which are generated by internal pressures of the container are largely in shear. Within the recess the ring member provides a continuous path in which hoop stresses can be generated to restrain the eversion forces in that locality.

In order that the invention may be more fully understood embodiments thereof will now be described, by way of example, with reference to the accompanying drawings, in which.

Figure 1:
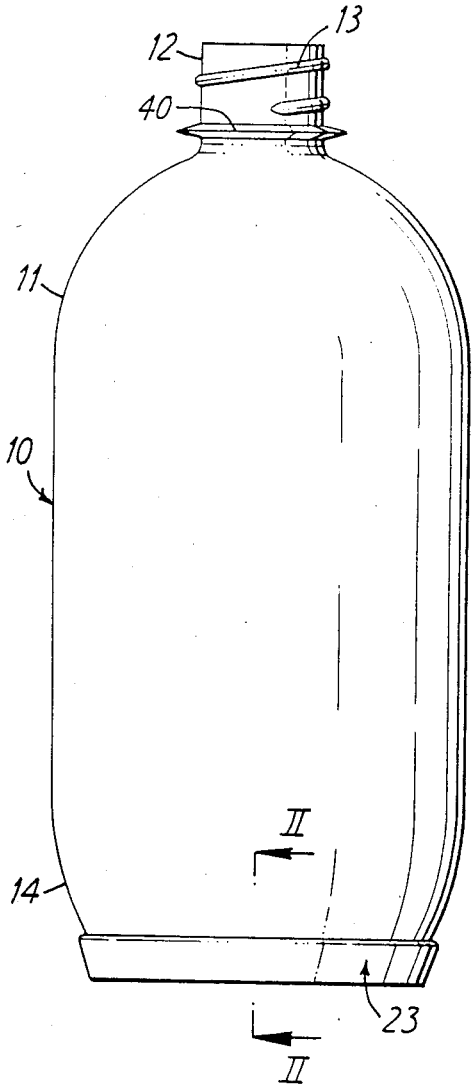
FIG. 1 shows a first polyethylene terephthalate (PET) bottle in accordance with the invention, as it is before filling with a carbonated beverage product and closing with a screw cap.

Referring firstly to FIG. 1, there is shown a bottle for carbonated beverages such as mixers for alcoholic drinks. The bottle has a body 10 which is integrally formed with a generally cylindrical side wall 11, a neck 12 with a screw thread 13 and gripping ring 40, and a base 14 (only partly visible in FIG. 1) by means of which the bottle may be stood upright when desired. For use, the bottle is filled and then closed in normal manner by a screw can (not shown) attached on the neck 12 by the screw thread 13.

Figure 2:
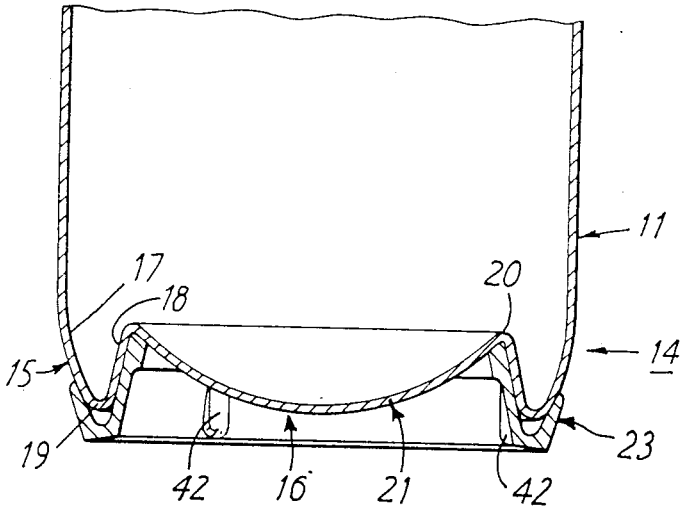
FIG. 2 is an enlarged view of the bottom part of the bottle as seen in diametral section on the line II—II of FIG. 1 after the bottle has been filled and closed.

The body 10 is conventionally moulded from polyethylene terephthalate polymer (PET) by blow moulding an injection moulded preform or an extruded tubular parison. The configuration of its base 14 is shown in FIG. 2, in which it will be seen to have an annular standing ring 15 and a recess or concavity 16 within the standing ring.

The standing ring 15 is formed of outer and inner substantially frustoconical wall 17, 18 joined along a continuous rounded crest 19. The outer wall 17 merges with the bottle side wall 11 around the periphery of the base 14. The inner wall 18 extends from the crest 19 inwardly and upwardly to an elbow 20 at which it joins the circular outer periphery of a convexly domed central panel 21 of the base. The base 14 thus comprises the standing ring 15 formed of the walls 17, 18 and joined along the crest 19, and the central panel 21 which together with the wall 18 defines the recess 16.

In addition to the body 10 the bottle comprises an injection-moulded ring member 23. The ring member 23 is annular, and as seen in cross-section (FIGS. 2 and 3) has a longer inner flange 24 and a shorter outer flange 25 joined to defined a V-section channel in which the crest 19 of the standing ring is nested. To that end the flanges have opposed frustoconical faces 26, 27 which are joined by an annular radius 28 at the base of the channel and are inclined to one another by the angle which the walls of the standing ring will adopt when the bottle is pressurised with product. The free edge of the inner flange 24 is formed as a further, shallowly frustoconical face conforming to the outer margin of the central panel 21 in the pressurised bottle.

Figure 4:
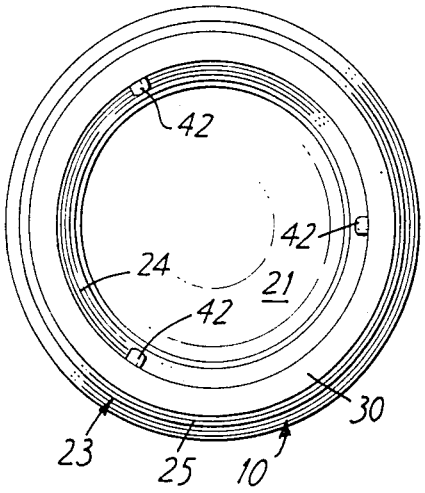
FIG. 4 shows the bottle in underplan view.
Figure 3A:
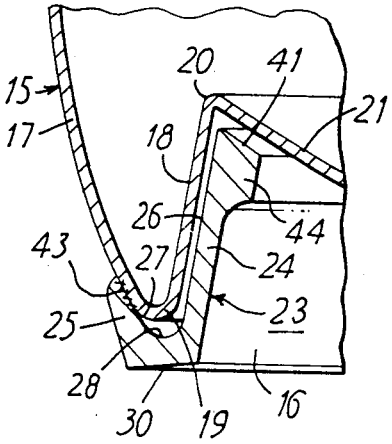
FIGS. 3A and 3B are enlarged scrap views of the heel area of the bottle, respectively showing the relation of the bottle body and the ring member before and after pressurisation.

The ring member is injection-moulded from PET, and after location on the body in the position shown in FIG. 3A is fused directly to the body by a conventional spin-welding operation in which the ring member is rotated at high speed when pressed against the body. Lugs 42 (FIGS. 2 and 4) are moulded on the inside of the ring member to provide for positive engagement by the spin-welding apparatus (not shown).

Figure 3B:
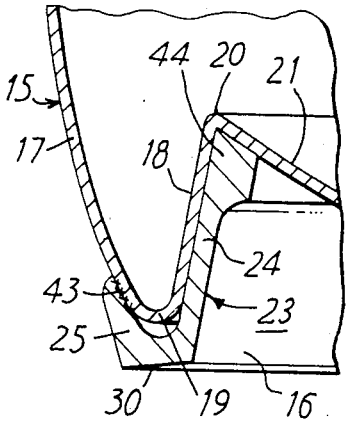

During spin-welding the bottle is empty of product and is therefore unpressurised, and, as shown in FIG. 3A, contact of the ring member with the body 10 is restricted to the face 27 of the outer flange 25. As indicated at 43, the fusion effected by spin-welding is accordingly limited to this location, that is to say, outboard of the crest 19 of the standing ring. However, after the bottle has been filled with a carbonated beverage product and closed with a screw cap, the carbonation pressure causes the crest 19 to open or "roll" out and the central panel 21 to adopt a more domed configuration. These movements are small but sufficient to bring the inner wall 18 of the standing ring 15 and the outer margin of the central panel into face-to-face contact with, respectively, the opposed faces 26 and 41 presented by the ring member 23. The inner flange 24 therefore nests snugly into the elbow 20 to restrain further movement in that locality. the relation of the ring member and the body 10 of the filled and closed bottle is therefore as shown in FIG. 3B, from which it will be understood that the standing ring is firmly restrained on both sides of the crest 19 against any further opening or rolling out movement in response to the carbonation pressure. The crest itself is still relieved from engagement with the ring member. By virtue of relative longitudinal movement which occurs between the inner wall 18 and the inner flange 24 as the container is being pressurised, the forces between the body 10 and the ring member 23 are substantially normal to the interface of the items 18, 24; however, between the outer wall 17 and the outer flange 25 the corresponding forces are directed substantially along the interface so that the spin-welded bond 43 is largely in shear. The bond is, accordingly, best located to withstand any separation or cam-out forces between the body and the ring member caused by the carbonation pressure.

The face 41 is provided by a thickened end portion 44 of the inner flange 24, in which compressive hoop stresses can be generated to react with the substantial positive pressure which may be exerted on the ring member by the body 10 in that region. It is believed that the pressure progressively reduces along the inner flange 24 in the direction of the crest 19, i.e. in the downward direction as seen in FIGS. 1 to 3, but the bond 43 prevents any tendancy for the body to separate from the surface 26 adjacent to the crest 19.

From the foregoing it will be understood that the ring member serves in an unobtrusive manner, and with a small requirement of material, to hold the bottle base against uncontrolled distortion so that it can be stood upright at all times. For that purpose it has a substantially plane, annular standing surface 30 opposite the radius 28. Some distortion of the PET material of the base 14 will occur both within and outside the ring member, but this will not be apparent to the consumer and will not impair the stability of the bottle.

The ring member is advantageously formed, like the body 10, from PET polymer. The formation of the ring member from the same polymer as the body 10 and its attachment by fusion rather than by an adhesive then enable the bottle material to be readily recycled after use without contamination and without any need to separate the ring member and body from one another beforehand, providing that the bottle is not coated with a different plastic. Furthermore, by use of suitable blow moulding techniques the PET material of the base 14 can be biaxially oriented, that is, partially crystallised, with little or no completely amorphous material remaining; the ring member itself may be rendered crystalline by suitable heat treatment before attachment to the container body, with the result that the assembled container may be thermally stable even under pasteurisation conditions.

In the embodiment described above the ring member is fused directly to the container body by spin-welding. However, other direct bonding methods may be used, for example ultrasonic welding or heat sealing.

Figure 5:
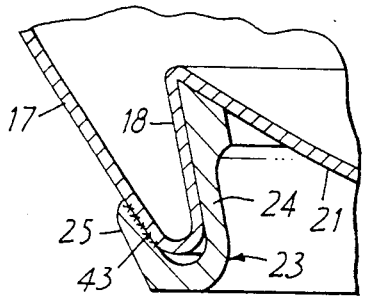
FIG. 5 is a view corresponding to FIG. 3B of a second embodiment of the invention.

FIG. 5 shows an embodiment of the invention in which the ring member is held mechanically in place on the container body in addition to being bonded thereto. The ring member 23, is similar to that of the first embodiment in that it has generally frustoconical inner and outer flanges 24', 25' forming a channel in which the crest 19 of the bottle standing ring 15 is located. However, in this embodiment the inner flange 24' is made upwardly divergent. The inner wall 18' of the bottle standing ring likewise has a reverse taper and so locks the ring member mechanically in position against the base. This mechanical interlocking supplements the bond 43 which is formed between the outer flange 25' and the outer wall 17' by spin-welding, ultrasonic welding, adhesive or the like as in the embodiment of FIGS. 1 to 4, whilst again allowing the relative movement of that embodiment between the container and the ring member when the container is pressurised (FIGS. 2 and 3). Thus FIG. 5 is a hybrid arrangement having both mechanical and bonded attachment of the ring member to the container.

Figure 6:
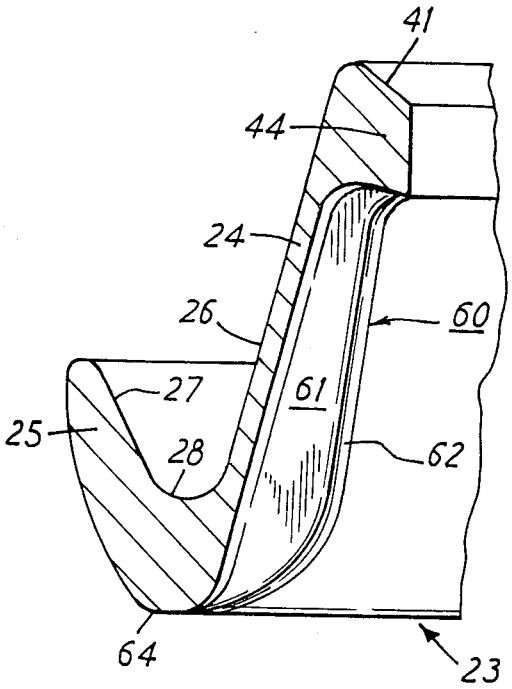
FIG. 6 shows the ring member of a third embodiment of the invention as seen on a section taken adjacent one of the strengthening ribs thereof.

FIG. 6 shows a modification of the embodiment shown in FIGS. 1 to 5 in which a plurality, e.g. 12 strengthening ribs 60 are moulded on the inner face of the inner flange 24 of the ring member. The ribs, of which only one is shown, are regularly spaced around the ring member; they are axially directed and project radially into the recess 16. They merge at their top ends with the underside of the thickened top end portion 44 of the ring member, and from there extend downwardly to merge with the generally rounded base 64 of the ring member at their bottom ends. In FIG. 6 one of the side faces of the rib 60 is visible and denoted by the reference numeral 61, and the inwardly facing surface between the two sides is denoted 62.

Although specifically described in relation to screw-top bottles for carbonated beverages and made from PET, the invention has application to other types of container, for use with other types of product (whether pressure-generating or otherwise), and made of other thermoplastics resins. One such container is again proposed for a carbonated beverage product and made of PEt, but has the form of a wide-mouthed can rather than a screw-top bottle as particularly described above.

Although preferred, it is not essential that the base of a container in accordance with the invention should have a discrete and outwardly domed central panel within the inner wall of the standing ring. For example, the base may be inwardly domed and arcuate, so as to be wholly concave to the exterior of the container and lacking any central panel which is recognisable as such. With such an arrangement the ring member will usually be arranged to extend over an outer marginal region only of the recess.

Production methods other than blow-moulding and injection moulding can be used for, respectively, the container body and the ring member. For example, the ring member can be thermoformed.

We claim:

1. A thermoplastics container having a body with a standing base, the base being formed with a central recess and having a standing ring with a crest which defines the periphery of the recess, for controlling distortion of the base against internal pressure of the container, the container further including a ring member which receives the crest of the standing ring in generally nested relation, the ring member being of a thermoplastics material which is mutually weldable with that of the base, and the ring member being welded to the base radially outwardly of the crest but radially inwardly of the crest being free of the base so that the base is movable relative thereto, said ring member and base comprising means whereby, radially inwardly of the crest, the base is spaced from the ring member when the container is unpressurised, but moves into abutment with the ring member and is thereby supported against further distortion when the container is pressurised.

2. A container according to claim 1, wherein the ring member and the body are moulded from the same thermoplastics polymer.

3. A container according to claim 1, wherein the ring member is spin-welded to the body base.

4. A container according to claim 1, arranged so that, when pressurised, the weld between the ring member and the body base outside the crest is substantially in shear, whereas within the crest the forces between the body base and the ring member at the said abutment therebetween are substantially normal to the interface of the body base and the ring member.

5. A container according to claim 1, wherein the standing ring has a substantially frustoconical inner wall and an upwardly and outwardly tapering, substantially frustoconical outer wall and the body base further comprises a convexly domed central panel joined to the inner periphery of the inner wall at an elbow, and located within the recess.

6. A container according to claim 5, wherein the ring member is adapted to engage the inner frustoconical wall over substantially the whole of its length, and has a terminal surface for engagement with an outer marginal region of the central panel.

7. A container according to claim 6, wherein the terminal surface is provided by a thickened terminal portion of the ring member, within which substantial hoop stresses may be generated when the container is pressurised.

8. A container according to claim 5, wherein the inner wall of the standing ring tapers inwardly and upwardly.

9. A container according to claim 1, wherein the standing ring has a substantially frustoconical inner wall which tapers outwardly and upwardly, and the ring member is adapted to correspondingly engage the inner wall so as to be mechanically interlocked to the container body by such engagement.

10. A container according to claim 1, wherein within the recess the ring member is formed with a plurality of circumferentially spaced, inwardly projecting strengthening ribs.

11. A container according to claim 1, wherein at least the body is moulded from PET.

12. A container according to claim 1, wherein the body base is biaxially oriented so as to include little or no amorphous material and the ring member is rendered crystalline by heat treatment, the container thereby having thermal stability to elevated temperatures.

* * * * *